US006454572B1

(12) United States Patent
Konetski et al.

(10) Patent No.: US 6,454,572 B1
(45) Date of Patent: Sep. 24, 2002

(54) SURFACE MOUNT CONNECTOR

(75) Inventors: Tom John Konetski, Berthoud; Marc Jacques Lalouette, Longmont, both of CO (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/717,516

(22) Filed: Nov. 20, 2000

Related U.S. Application Data

(60) Provisional application No. 60/184,944, filed on Feb. 25, 2000.

(51) Int. Cl.[7] ..... H01R 12/00

(52) U.S. Cl. ..... 439/66; 439/74; 439/81; 439/76.1; 361/784; 361/790

(58) Field of Search ..... 439/65, 66, 74, 439/79, 80, 76.1, 81; 361/784, 787, 790

(56) References Cited

U.S. PATENT DOCUMENTS

| | | | | |
|---|---|---|---|---|
| 5,132,876 A | | 7/1992 | Ma | |
| 5,214,567 A | | 5/1993 | Feightner et al. | |
| 5,216,583 A | | 6/1993 | Katsumata | |
| 5,435,737 A | | 7/1995 | Haga et al. | |
| 5,454,080 A | | 9/1995 | Fasig et al. | |
| 5,500,779 A | * | 3/1996 | Diel | 360/97.01 |
| 5,751,514 A | * | 5/1998 | Hyde et al. | 360/97.01 |
| 5,793,998 A | | 8/1998 | Copeland et al. | |
| 5,816,861 A | * | 10/1998 | Cheng | 439/66 |
| 5,822,184 A | | 10/1998 | Rabinovitz | |
| 5,897,386 A | | 4/1999 | Baxter et al. | |
| 6,022,224 A | * | 2/2000 | Peters | 439/66 |
| 6,064,567 A | | 5/2000 | Cheng | |
| 6,068,514 A | | 5/2000 | Zuin | |
| 6,178,629 B1 | * | 1/2001 | Rathburn | 29/843 |

* cited by examiner

*Primary Examiner*—Tho D. Ta
*Assistant Examiner*—Truc Nguyen
(74) *Attorney, Agent, or Firm*—Steven J. Spellman; Merchant & Gould P.C.

(57) ABSTRACT

An apparatus and method for making a solderless electrical connection between a plurality of electrical contact pads on a disc drive printed circuit board (disc drive PCB) and a plurality of electrical contact pads on a external printed circuit board (external PCB). The apparatus and method involve or include a connector which is operable for mounting directly on the disc drive PCB. The connector preferably includes a plurality of electrically conductive pins operable for simultaneously connecting the contact pads on the disc drive PCB to the contact pads on the external PCB when the connector is mounted to the disc drive PCB and the disc drive is mounted to the external PCB.

13 Claims, 6 Drawing Sheets

SURFACE MOUNT CONNECTOR

RELATED APPLICATIONS

This application claims priority of United States provisional application Serial No. 60/184,944, filed Feb. 25, 2000.

FIELD OF THE INVENTION

This application relates generally to connectors and more particularly to a connector which mounts to the surface of a disc drive printed circuit board and which provides a solderless connection between the disc drive printed circuit board and a printed circuit board which is external to the disc drive.

BACKGROUND OF THE INVENTION

In recent years mobile computing devices, particularly laptop computers and hand held computing devices, have become extremely popular for a wide variety of home, business and commercial uses. Such devices commonly include a main central processor unit along with additional support circuitry which are mounted on a printed circuit board, commonly called a motherboard. Additionally, these devices typically contain one or more non-volatile mass storage devices. In laptop computers, the type of mass storage device generally employed is a storage disc or discs, sometimes referred to as "hard discs." Hard discs are provided as part of a Winchester-type disc drive unit having the storage discs supported in a stack on a rotary spindle within a substantially sealed disc drive housing. Winchester-type disc drives are commonly referred to as hard drives, hard disc drives, or simply disc drives. Disc drives are the preferred form of mass storage device in laptop computers as they provide a stable, high capacity, and low cost mechanism for the storage of computer data.

In a typical laptop computer the disc drive is mounted some distance away from the computer motherboard in a disc drive bracket on the inside of the laptop case. While this type of mounting arrangement provides for the stable retention of the disc drive in the laptop case, the process of mounting the disc drive bracket to the case and then mounting the disc drive in the bracket consumes valuable time, and thus costs, in the laptop production process. Additionally, the disc drive bracket consumes valuable space in the laptop case.

Once the disc drive is mounted in the case, the disc drive is generally connected to the motherboard via a ribbon cable. A ribbon cable comprises a flat, flexible cable containing a plurality of electrical wires that are aligned in a row. Attached at each end of the ribbon cable is connector having a plurality of female slots. Soldered to both the motherboard and the disc drive is a male connector having a plurality of pins which are spaced so as to align with the female slots of the ribbon cable connector. The connectors on the ribbon cable are attached to the connectors on the motherboard and disc drive, thereby establishing an electrical connection between disc drive and the motherboard via the ribbon cable.

While the use of ribbon cables and connectors has become commonplace in computers, including laptop computers, there are a number of disadvantages associated with the use of ribbon cables and connectors to connect the disc drive to the motherboard. For example, the capacitance which is inherent in the ribbon cable, the male and female connectors, and the solder used to attach the male connectors to the disc drive and the motherboard causes a decreased electrical efficiency and a lowering of the signal transfer rates between the motherboard and the disc drive. Additionally, the process of soldering the male connectors to the motherboard and disc drive is time intensive and costly. Also, the cost of the cable and the connectors adds to the cost of manufacturing the disc drive. Finally, the cables and connectors consume valuable space within the laptop computer case.

In addition to or in place of disc drives, laptop computers may also use other types of non-volatile mass storage devices, such as electrically erasable programmable read-only memory (EEPROM) or flash memory. EEPROM and flash type memories are silicon, or transistor based solid state devices. Hand held computing devices generally use EEPROM or flash memory type mass storage device. EEPROM and flash type memories may either be built into the laptop or hand held device or, more commonly, plugged into Personal Computer Memory Card International Association (PCMCIA) slots or Peripheral Component Interface (PCI) slots in the laptop or hand held device.

The small size and low power requirements of EEPROM and flash type memories have made them an attractive substitute for disc drives in mobile computing devices. However, recent advances in disc drive technologies, particularly in the area of size reduction and storage bit density, have made disc drives an increasingly attractive alternate to EEPROMs and flash type memories, particularly in hand held computing devices.

The primary advantage of disc drives over EEPROM and flash type memories is that disc drives are volumetrically more efficient. That is, disc drives provide greater data storage densities per device unit volume than do EEPROM or flash type memories. This ratio of device volume to memory capacity is known as the volumetric ratio of the device. For example, at the present time a typical 1.8 inch form factor ATA disc drive has about a 2 to 1 advantage in volumetric ratio to a flash memory device. As the form factor of the disc drive increases, so does the volumetric ration. For instance, at the present time a typical 2.5 inch form factor ATA disc drive has about a 8 to 1 volumetric ratio advantage over a flash memory device.

Additionally, the increase in volumetric ratios for EEPROM, flash type memories, and other silicon based memory devices is governed by Moore's Law, that is, the capacity or volumetric ratio of the EEPROM or flash type memory device doubles in capacity approximately every eighteen months. In contrast, the doubling of capacity in disc drives has been occurring about every twelve months. If such trends persist, disc drives will continue to widen their advantage in volumetric ratio compared to EEPROM, flash type memories, and other silicon based memory devices.

In addition to their superior volumetric efficiencies, disc drives also surpass flash memory devices in inherent transfer rates. The inherent transfer rate of a device is the rate at which the device transfers information from source to destination, for example, from the disc in the disc drive or the transistors in the flash memory to the output pads or pins of the device. Transfer rate is measured in units of information per unit of time, for example bits per second or characters per second. At present, disc drives have an inherent transfer rate approximately 10 times the inherent transfer rate of EEPROMS or flash type memory devices.

SUMMARY OF THE INVENTION

Against this backdrop the present invention has been developed. One aspect of the present invention is to provide an apparatus for electrically connecting a disc drive printed circuit board (disc drive PCB) to a printed circuit board which is external to the disc drive (external PCB), such as a computer motherboard, without the use of electrically inefficient, costly, and space intensive cables which are commonly used to connect disc drive PCBs to external PCBs. Another aspect of the present invention involves an apparatus which eliminates the time intensive and costly step of soldering connectors to the external PCB and/or disc drive PCB. A further aspect of the present invention involves an apparatus which allows a disc drive to be directly mounted to a external PCB, thus eliminating the need for a disc drive mounting bracket, thereby saving valuable space within the computing device and providing a volumetrically efficient alternative to the use of EEPROM and flash type memory devices in mobile computing devices.

In accordance with these and other aspects, an improved connector of the present invention a connector operable for mounting directly on the disc drive PCB. The connector having a plurality of electrically conductive pins, each of the pins operable for simultaneously contacting one of the electrical contact pads on the disc drive PCB and one of the electrical contact pads on the external PCB when the connector is mounted to the disc drive PCB and the disc drive is mounted to the external PCB.

Another aspect of the present invention relates to a method for making a solderless electrical connection between a disc drive PCB and an external PCB. The method involves the steps of providing a connector having at least one electrically conductive pin having a first end and a second end, mechanically biasing the first end of the electrically conductive pin against the PCB electrical connection pad, and mechanically biasing the second end of the electrically conductive pin against the external PCB electrical connection pad, such that a solderless connection is formed between the PCB electrical connection pad and the external PCB electrical, connection pad.

These and various other features as well as advantages which characterize the present invention will be apparent from a reading of the following detailed description and a review of the associated drawings.

DETAILED DESCRIPTION

Figure 1:
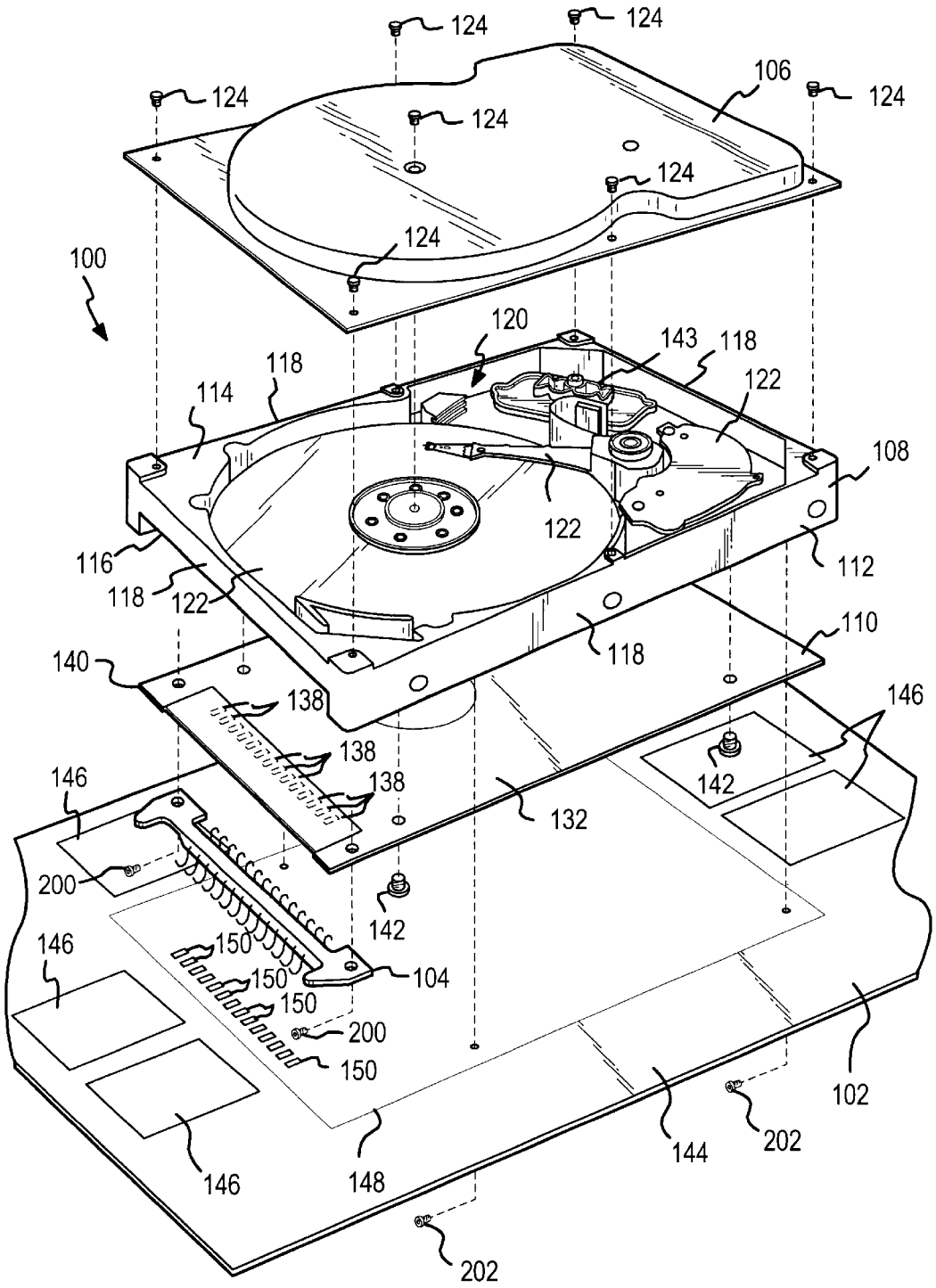
FIG. 1 is an exploded perspective view of an assembly of components embodying a preferred embodiment of the present invention, specifically illustrating a disc drive, a disc drive printed circuit board (disc drive PCB) a surface mount connector, and an external printed circuit board (external PCB) in accordance with a preferred embodiment of the present invention.

As shown in FIG. 1, a preferred embodiment of the present invention comprises a disc drive 100, which is physically mounted directly to a printed circuit board 102 which is external (external PCB) to the disc drive 100, and which is electrically connected to the external PCB 102 via a surface mounted connector 104 which makes a solderless electrical connection between the disc drive 100 and the external PCB 102. As described herein, the term solderless connection refers to an electrical connection between two or more metallic parts which does not require the process of joining the metallic parts to make an electrical contact by melting solder (usually tin and lead) across them. However, it is to be understood that the term solderless connection, as used herein, contemplates a connection between two or more metallic parts wherein any, all, or none of the metallic parts may have solder present on the surface, or where any, all, or none of the parts may be formed of solder.

As shown in exploded arrangement in FIG. 1, the disc drive 100 includes a cover 106, a base plate 108, and a printed circuit board (PCB) 110. The base plate 108 preferably comprises a body 112 having an upper surface 114, a lower surface 116, and four sides 118. As shown in FIG. 1, formed within the upper surface 114 of the base plate 108 is an upper cavity 120 into which various internal components 122 of the disc drive 100 are positioned and held. The cover 106 is preferably fasted to the upper surface 114 of the base plate 108 via a plurality of screws 124. The base plate 108 together with the cover 106 form a sealed environment for the internal components 122 of the disc drive 100.

Figure 2:
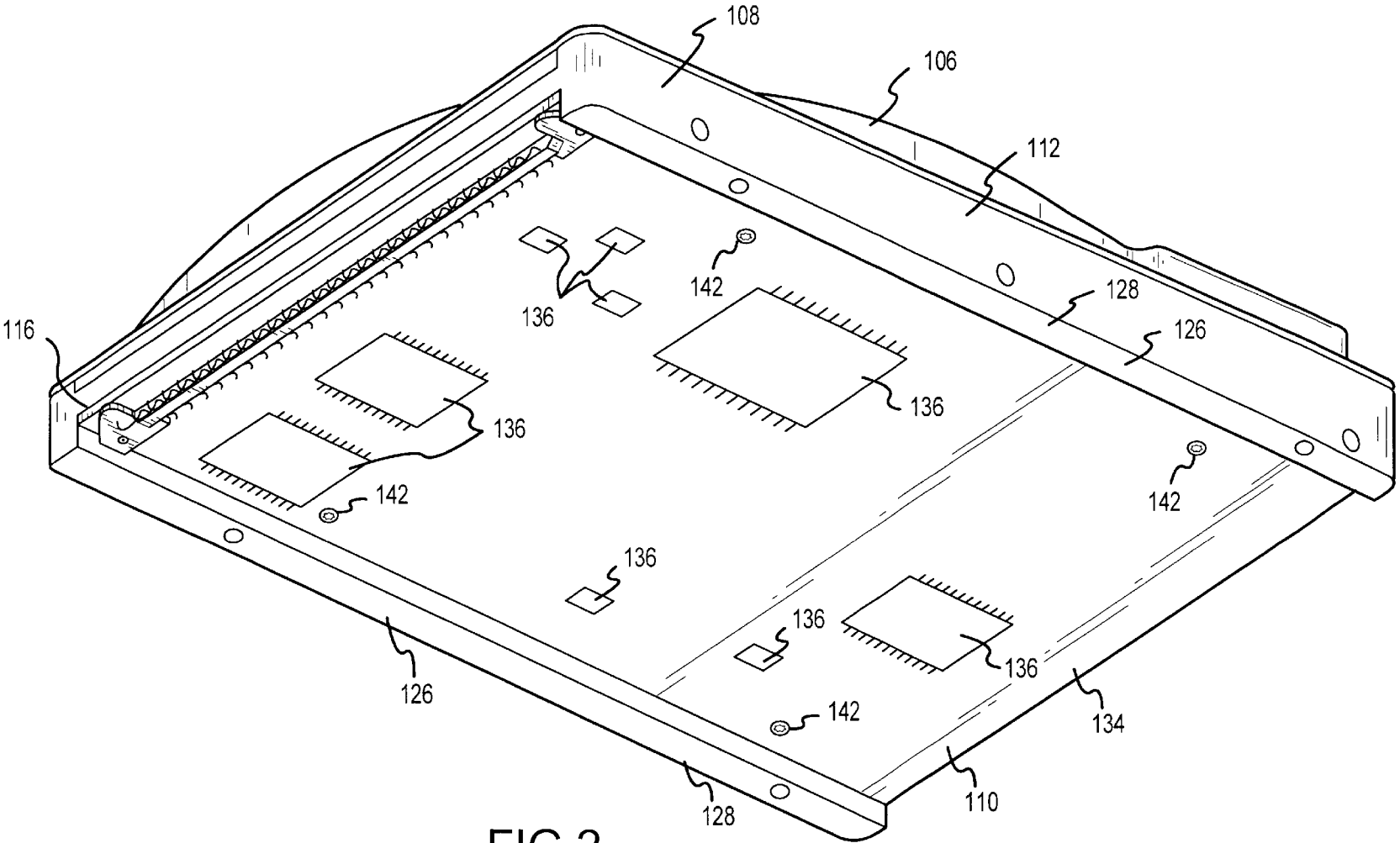
FIG. 2 is a perspective view of the disc drive and the surface mount connector of FIG. 1, showing the surface mount connector mounted to the disc drive printed PCB and the disc drive PCB mounted to the disc drive in accordance with a preferred embodiment of the present invention.

As shown in FIG. 2, the base plate 108 further comprises two rails 126 which are integrally formed with, and extend downward from, the lower surface 116 of the base plate 108. Each of the rails 126 has a substantially flat lower distal edge 128. The two rails 126 preferably extend an equal distance from the lower surface 116 of the base plate 108, such that the flat lower edges 128 of the rails 126 lie in a common plane.

The PCB 110 preferably comprises a firm planar substrate 130 having an upper surface 132 (FIG. 1) and lower surface 134. Affixed or imprinted on the lower surface 134 of the PCB 110 are various circuitry and components 136 necessary for the functioning of the disc drive 100. Additionally, a row of PCB contact pads 138 (shown as dashed line rectangles in FIGS. 3 and 4), which are electrically connected to the various circuitry and components 136 of the PCB 110, are located adjacent to an outer edge 140 of the lower surface 134 of the PCB 110.

As shown in FIG. 2, the PCB 110 is positioned in a recessed manner between the two rails 126 of the base plate 108 such that components 136 located along a lower surface 134 of the PCB 110 do not extend beyond the flat lower distal edges 128 of the rails 126, or through the common plane in which the distal edges 128 of two rails 126 lie. As shown in FIGS. 1 and 2, the PCB 110 is held in position generally in a plane parallel with the lower surface 116 of the base plate 108 by a plurality of screws 142. A connector 143 extends from the PCB 110 and through the base plate 108 to electrically connect the various circuitry and components 136 of the PCB 110 to the internal components 122 of the disc drive 100.

As shown in FIG. 1, the external PCB 102, to which the disc drive 100 is mounted, is primarily conventional, in that it is a printed circuit board having a firm planar substrate 144 onto which the basic circuitry and components 146 are imprinted or affixed. The external PCB 102 may comprise a computer system motherboard including all or some of the following components: a microprocessor, a coprocessors, memory, BIOS, expansion slots, various interfaces, serial and parallel ports, electrical traces, and/or various controllers which may be required to control peripheral devices. However, it is to be understood that the external PCB 102 may comprise any printed circuit which is external to the disc drive 100.

Apart from conventional elements, the external PCB 102 also includes a disc drive mounting area 148 and a plurality of disc drive connection pads 150. As shown in FIG. 1, the disc drive mounting area 148 comprises a region on the substrate 144 of the external PCB 102 which is free of all components and circuitry other than a plurality of disc drive connection pads 150. The size and shape of the disc drive mounting area 148 is preferably identical to, or larger than, the lower surface 116 of the base plate 108 of the disc drive 100, so that the circuitry and components 146 of the external PCB 102 will not touch or interfere with the disc drive 100. The disc drive connection pads 150 are electrically connected to various circuitry and components 146 of the external PCB 102, and are preferably identical in number, spacing, and arrangement to the PCB contact pads 138.

Figure 3:
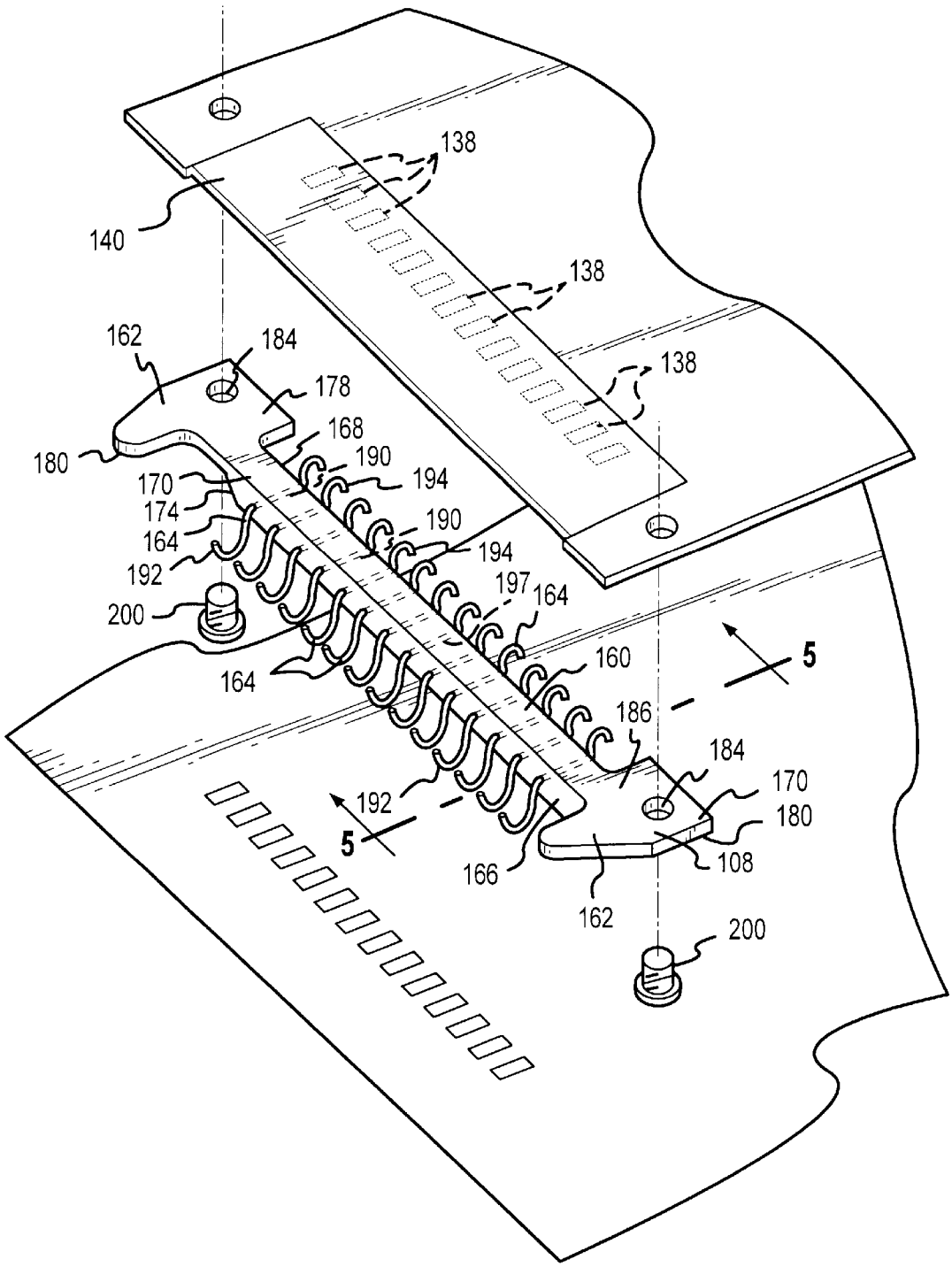
FIG. 3 is an enlarged exploded perspective view of a portion of the disc drive PCB, the surface mount connector, and the external PCB of a preferred embodiment of the present invention as shown in FIG. 1.

In a preferred embodiment of the present invention, the surface mount connector 104 is employed to electrically connect the PCB contact pads 138 to the disc drive connection pads 150. As shown in FIG. 3, surface mount connector 104 comprises an electrically insulative, elongate main body 160, two electrically non-conductive connection tabs 162, and a plurality of electrically conductive pins 164. The main body 160 of the connector 104 preferably comprises a front wall 166, a back wall 168, a top wall 170, a bottom wall 172 (shown in FIG. 5), and two side walls 174.

The two tabs 162 of the connector 104 each preferably comprise a substantially flat body portion having an upper surface 178 and a lower surface 180. Additionally, each of the tabs 162 preferably defines a substantially round hole 184 extending between the upper 178 and lower 180 surfaces of the tabs 162. Each of the tabs 162 is connected to, and extends from, an opposite end of the main body 160, such that the upper surfaces of the tabs 178, together with the top wall 170 of the main body 160, form a planer upper surface 186 of the connector 104. The main body 160 and the two connection tabs 162 of the connector 104 are preferably formed of non-electrically conductive material as one integral unit.

Figure 4:
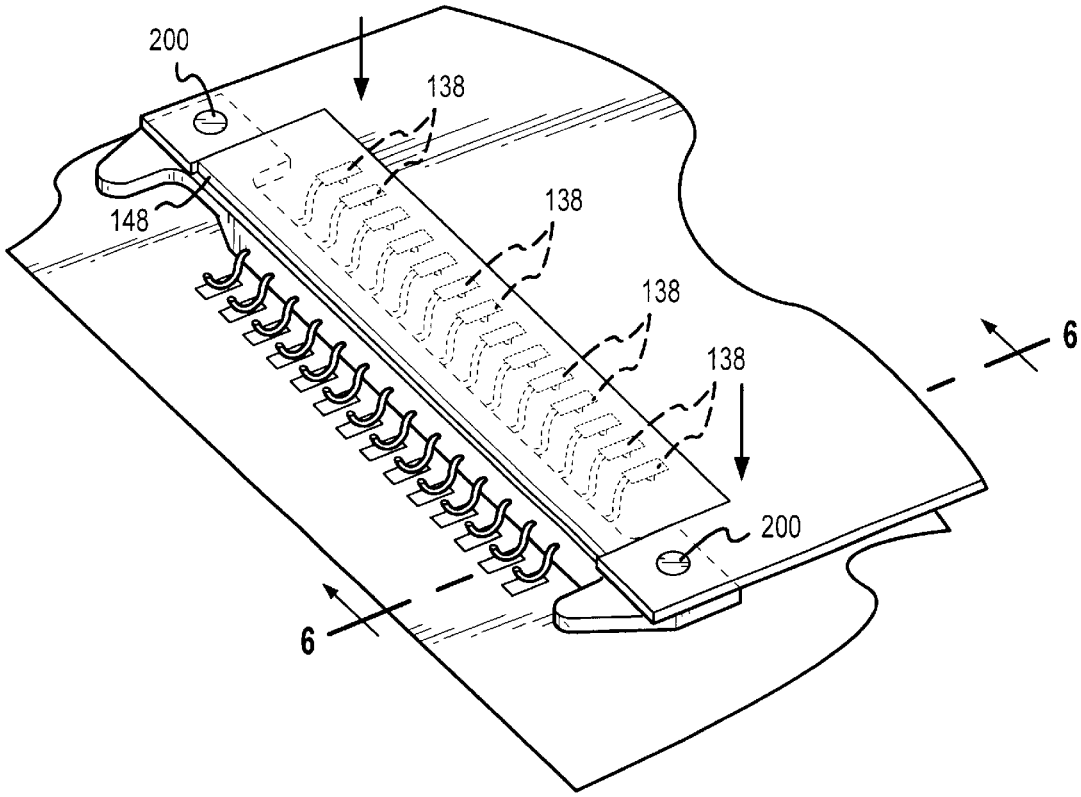
FIG. 4 is a partial perspective view of the surface mount connector of FIG. 1 mounted to the disc drive PCB and contacting external PCB mounting pads on the external PCB in accordance with a preferred embodiment of the present invention.
Figure 5:
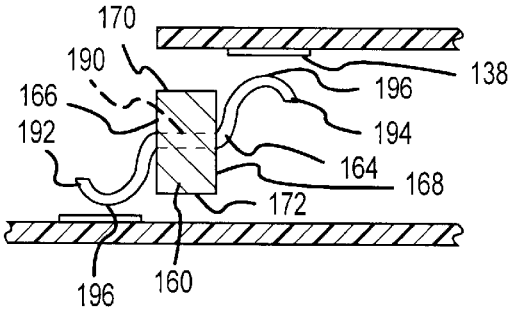
FIG. 5 is a partial vertical cross-sectional view of the disc drive PCB, the surface mount connector, and the external PCB shown in FIG. 3, taken in the plane of 5—5.

As shown in FIGS. 3, 4, and 5, each of the electrically conductive pins 164 preferably comprises a single integral resilient elongate rod of electrically conductive material having straight middle portion 190, a U-shaped front portion 192, and a U-shaped back portion 194. Each of the U-shaped portions 192 and 194 of the conductive pins 164 has a contact portion 196. The middle portion 190 of each conductive pin 164 passes through, and is firmly held within, a passageway 197 within the main body 160 of the connector 104. As shown in FIG. 5, the U-shaped front portion 192 of each conductive pin 164 extends downward and away from the front wall 166 of the main body 160 of the connector 104, such that the contact portion 196 of the front portion 192 extends below the bottom wall 172 of the main body 160 of the connector 104. The U-shaped back portion 194 of each conductive pin 164 extends upward and away from the back wall 168 of the main body 160 of the connector 104, such that the contact portion 196 of the back portion 194 extends above the top wall 170 of the main body 160 of the connector 104.

Figure 6:
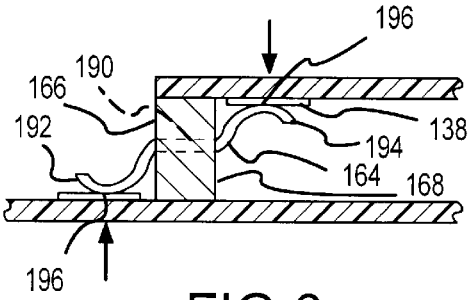
FIG. 6 is a partial vertical cross-sectional view of the disc drive PCB, the surface mount connector, and the external PCB shown in FIG. 4, taken in the plane of 6—6.

As shown in FIGS. 1, 3, and 4, the connector 104 is mounted to the PCB 110 via a pair of screws 200, such that the contact portion 196 of the U-shaped back portions 194 of each of the pins 164 is aligned with, and comes in contact with, a respective PCB contact pad 138. As shown in FIGS. 4 and 6, the resilient nature of the conductive pins 164 allows each of the U-shaped back portions 194 to act as a spring, thus keeping the contact portion 196 of the U-shaped back portions 194 of each of the pins 164 in firm contact with the respective PCB contact pads 138 without the need to solder the pin contact portions 196 to the PCB contact pads 138.

As shown in FIGS. 1, 3, and 4, once the connector 104 is connected to the PCB 110, the disc drive 100, together with the connector 104, is positioned in the disc drive mounting area 148 such the contact portion 196 of the U-shaped front portions 192 of each of the pins 164 is aligned with, and comes in contact with, a respective disc drive connection pads 150 of the external PCB 102. As shown in FIGS. 4 and 6, the resilient nature of the conductive pins 164 allows each of the U-shaped front portions 192 to act as a spring, thus keeping the contact portion 196 of the U-shaped front portions 192 of each of the pins 164 in firm contact with the respective disc drive connection pads 150 of the external PCB 102, without the need to solder the contact portions 196 to the disc drive connection pads 150. As shown in FIG. 1, the disc drive 100 is then connected to the external PCB 102 via a plurality of screws 202.

An alternative embodiment of the present invention is shown in FIGS. 7–10. As in the preferred embodiment of the present invention, the alternative embodiment of the present invention comprises a disc drive 100, which is physically mounted directly to a external PCB 102, and which is electrically connected to the external PCB 102 via a surface mounted connector 204. As explained in greater detail below, the primary differences between the preferred embodiment of the present invention and this alternative embodiment, relate to the arrangement of the various components of the PCB 210, the positioning of the surface mount connector 204 relative to the PCB 210 and the external PCB 102, and to the placement of the various components of the surface mount connector 204.

Figure 7:
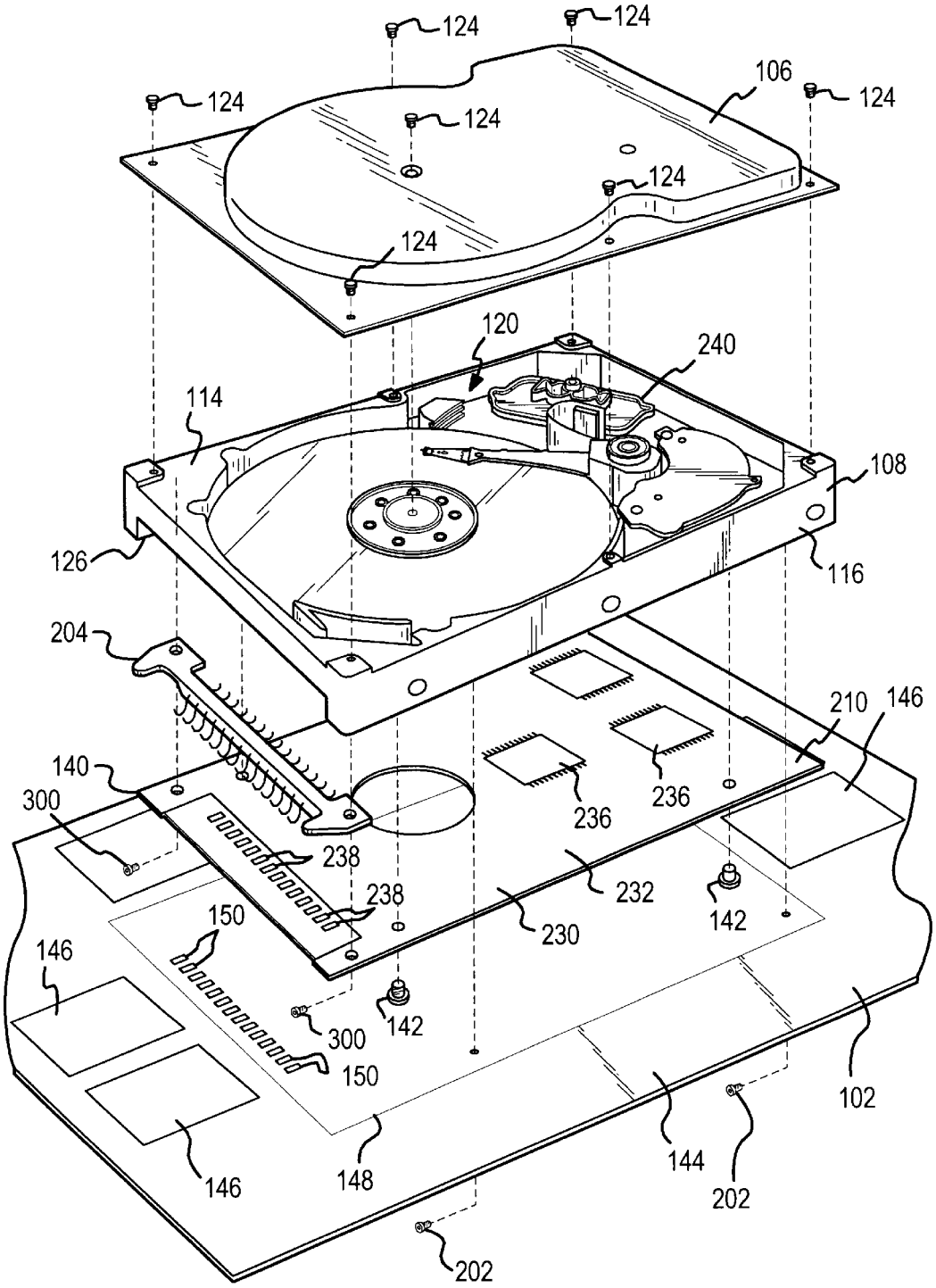
FIG. 7 is an exploded perspective view of an assembly of components embodying an alternative embodiment of the present invention, specifically illustrating a disc drive, a disc drive PCB, a surface mount connector, and a external PCB in accordance with a preferred embodiment of the present invention.

As shown in exploded arrangement in FIG. 7, the disc drive 100 of the alternative embodiment of the present invention includes a cover 106, a base plate 108 and PCB 210. Like the PCB 110 in the preferred embodiment of the present invention, the PCB 210 of the alternate embodiment preferably comprises a firm planar substrate 230 having an upper surface 232 and lower surface 234. However, unlike the PCB 110 of the preferred embodiment of the present invention, the various circuitry and components 236 of the PCB of this alternative embodiment are affixed or imprinted on the upper surface 232 of the PCB 210, with a row of PCB contact pads 238 located along an outer edge 140 of the upper surface 232 of the PCB 210.

The PCB 210 is positioned in a recessed manner between the two rails 126 of the base plate 108 such that components 236 located along a upper surface 232 of the PCB 210 face the lower surface 116 of the base plate 108. The PCB 210 is held in position generally in a plane parallel with the lower surface 116 of the base plate 108 by a plurality of screws 142. A connector 240 extends from the PCB 210 and through the base plate 108 to electrically connect the various circuitry and components 236 of the PCB 210 to the internal components 122 of the disc drive 100.

As shown in FIG. 7, the external PCB 102 includes a disc drive mounting area 148 and a plurality of disc drive connection pads 150. The disc drive mounting area 148 comprises a region on the substrate 144 of the external PCB 102 which is free of all components and circuitry other than the disc drive connection pads 150. The size and shape of the disc drive mounting area 148 is preferably identical to, or larger than, the lower surface 116 of the base plate 108 of the disc drive 100, so that the circuitry and components 146 of the external PCB 102 will not touch or interfere with the disc drive 100. The disc drive connection pads 150 are preferably identical in number, spacing, and arrangement to the PCB contact pads 238.

Figure 8:
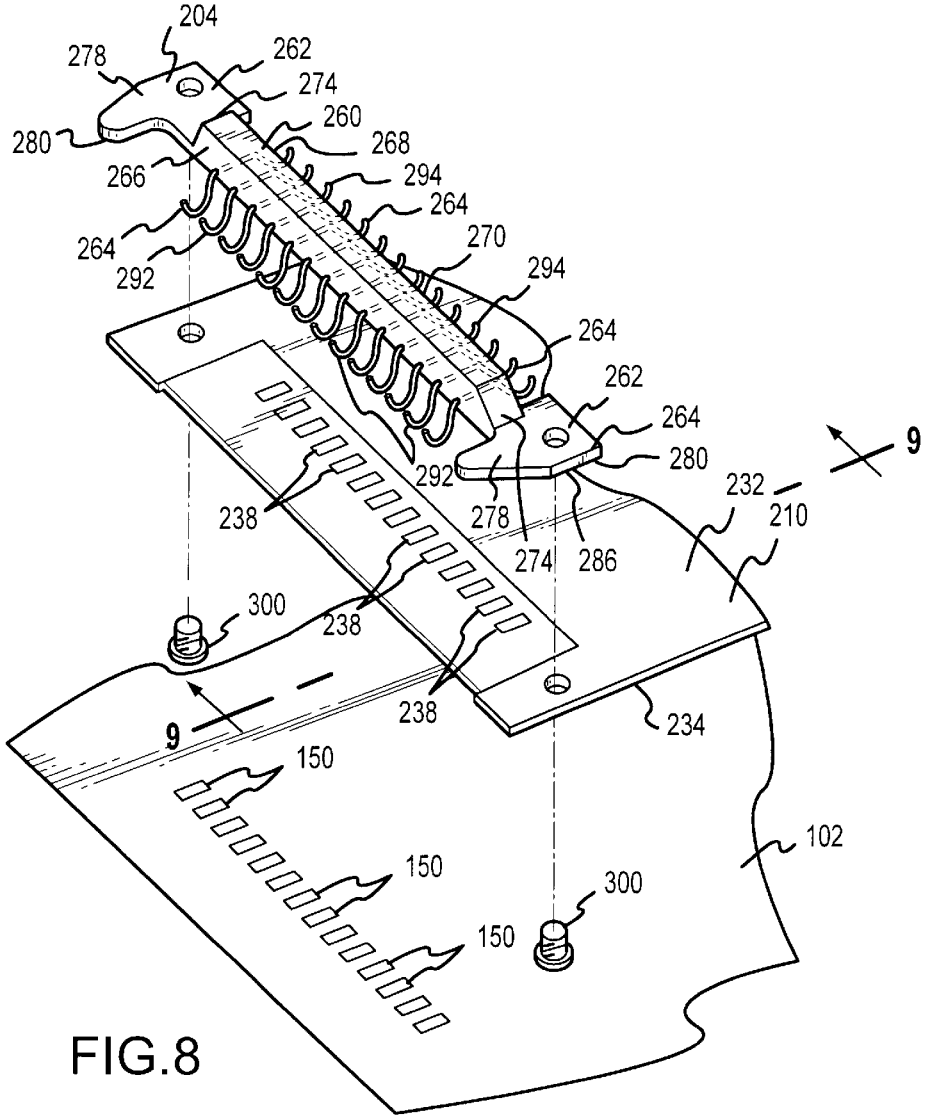
FIG. 8 is an enlarged exploded perspective view of a portion of the disc drive PCB, the surface mount connector, and the external PCB of the alternative embodiment of the present invention as shown in FIG. 7.

In this alternative embodiment of the present invention, the surface mount connector 204 is employed to electrically connect the PCB contact pads 238 to the disc drive connection pads 150. As shown in FIG. 8, surface mount connector 204 comprises an electrically non-conductive elongate main body 260, two electrically non-conductive connection tabs 262, and a plurality of electrically conductive pins 264. The main body 260 of the connector 204 preferably comprises a front wall 266, a back wall 268, a top wall 270, a bottom wall 272 (as shown in FIG. 9), and two side walls 274.

The two tabs 262 of the connector 204 each preferably comprise a substantially flat body portion having an upper surface 278 and a lower surface 280. Additionally, each of the tabs 262 preferably defines a substantially round hole 284 extending between the upper 278 and lower 280 surfaces of the tabs 262. Each of the tabs 262 is connected to, and extends from, an opposite end of the main body 260, such that the lower surfaces 280 of the tabs, together with the bottom wall 272 of the main body 260, form a planer lower surface 286 of the connector 204. The main body 260 and the two connection tabs 262 of the connector 204 are preferably formed from non-electrically conductive material as one integral unit.

Figure 9:
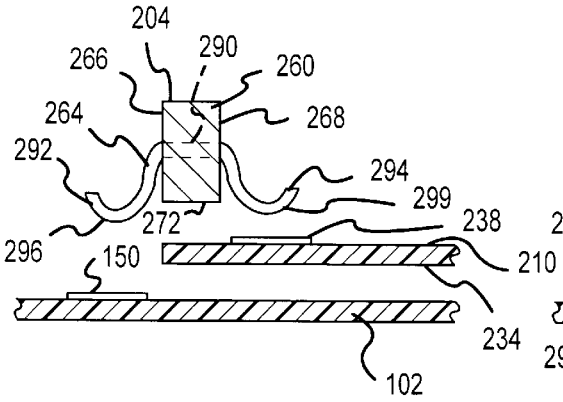
FIG. 9 is a partial vertical cross-sectional view of the disc drive PCB, the surface mount connector, and the external PCB shown of the alternative embodiment of the present invention shown in FIG. 8, taken in the plane of 9—9.

As shown in FIGS. 7–10, each of the electrically conductive pins 264 preferably comprises a single integral resilient rod of electrically conductive material having straight middle portion 290, a U-shaped front portion 292, and a U-shaped back portion 294. Each of the U-shaped portions 292 and 294 of the conductive pins 264 has a contact portion 296. The middle portion 290 of each conductive pin 264 passes through, and is held within, the main body 260 of the connector 204. As shown in FIG. 9, the front portion 292 of each conductive pin 264 extends downward and away from the front wall 266 of the main body 260 of the connector 204, such that the contact portion 296 of the front portion 292 extends below the bottom wall 272 of the main body 260 of the connector 204 and below the lower surface 234 of the PCB 210 when the connector 204 is connected to the PCB 210. The back portion 294 of each conductive pin 264 extends downward and away from the back wall 268 of the main body 260 of the connector 204, such that the contact portion 296 of the back portion 294 extends below the bottom wall 272 of the main body 260 of the connector 204.

Figure 10:
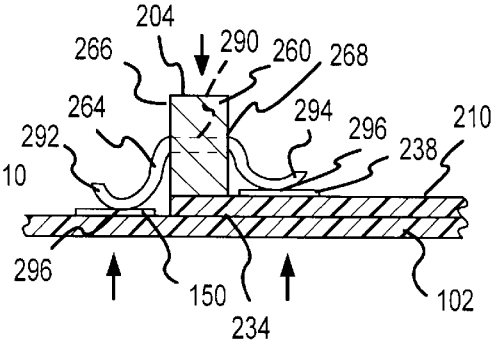
FIG. 10 is a partial vertical cross-sectional view of the disc drive PCB, the surface mount connector, and the external PCB of the alternative embodiment of the present invention which is taken in a similar plane as that shown in FIG. 9, showing the surface mount connector contacting pads on both the external PCB and the PCB board.

As shown in FIGS. 7 and 8, the connector 204 is mounted to the PCB 210 via a pair of screws 300, such that the contact portion 296 of the U-shaped back portions 294 of each of the pins 264 is aligned with, and comes in contact with, a respective PCB contact pad 238, without the need to solder the pin contact portions 296 to the PCB contact pads 238 (FIGS. 9 and 10). As shown in FIG. 10, the resilient nature of the conductive pins 264 allows each of the U-shaped back portions 294 to act as a spring, thus keeping the contact portion 296 of the U-shaped back portions 294 of each of the pins 264 in firm contact with the respective PCB contact pads 238.

As shown in FIGS. 10, once the connector 204 is connected to the PCB 210, the disc drive 100 (not shown), together with the connector 204, is positioned in the disc drive mounting area 148 such the contact portion 296 of the U-shaped front portions 292 of each of the pins 264 is aligned with, and comes in contact with, a respective disc drive connection pads 150 of the external PCB 102. As shown in FIGS. 10, the resilient nature of the conductive pins 264 allows each of the U-shaped front portions 292 to act as a spring, thus keeping the contact portion 296 of the U-shaped front portions 292 of each of the pins 264 in firm contact with the respective disc drive connection pads 150 of the external PCB 102, without the need to solder the pin contact portions 296 to the disc drive connection pads 150. As shown in FIG. 7, the disc drive 100 is then connected to the external PCB 102 via a plurality of screws 202.

In summary, in view of the foregoing discussion it will be understood that a preferred embodiment of the present invention provides a connector (such as 104 or 204) for making a solderless electrical connection between a plurality of electrical contact pads (such as 138 or 238) on a disc drive PCB (such as 110 or 210), which is mounted to a disk drive (such as 100), and a plurality of electrical contact pads (such as 150) on an external PCB (such as 102). The connector (such as 104 or 204) preferably comprises a plurality of electrically conductive pins (such as 164 or 264), wherein each of the pins (such as 164 or 264), is operable to simultaneously springingly contact one of the electrical contact pads (such as 138 or 238) on the disc drive PCB (such as 110 or 210) and one of the electrical contact pads (such as 150) on the external PCB (such as 102), such that each of the electrical contact pads (such as 138 or 238) on the disc drive PCB (such as 110 or 210) is in electrical connection with a corresponding electrical contact pad (such as 150) on the external PCB (such as 102) when the connector (such as 110 or 210) is mounted to the disc drive PCB (such as 10 or 210) and the disc drive is mounted to the external PCB (such as 102).

In the preferred embodiment of the invention, the connector (such as 104 or 204) preferably comprises an insulative housing (such as 160 or 260) having a plurality of passageways (such as 197 or 297) formed through the housing (such as 160 or 260) and receiving the pins (such as 164 or 264). Each of the pins (such as 164 or 264) preferably comprises a fixed portion (such as 190 or 290), an external PCB contacting portion (such as 192 or 292), and a disc drive PCB contacting portion (such as 194 or 294). The fixed portion (such as 190 or 290) of the pins (such as 164 or 264) is preferably secured in the passageway (such as 197 or 297), the external PCB contacting portion (such as 192 or 292) preferably extends out from the housing (such as 160 or 260) for springingly contacting a pad (such as 150) on the external PCB (such as 102), and the disc drive PCB contacting portion (such as 194 or 294) preferably extends out from the passageway (such as 197 or 297) for springingly contacting a pad (such as 138 or 238) of the disc drive PCB. The housing also preferably further comprises a top wall (such as 170 or 270), wherein a portion (such as 196 or 296) of each pin (such as 164 or 264) extends above the top wall (such as 170 or 270), such that the disc drive PCB contacting portion of each pin (such as 194 or 294) is springingly biased against an electrical contact pad (such as 138 or 238) on the disc drive PCB (such as 110 or 210) when the top wall (such as 170 or 270) is mounted to the disc drive PCB (such as 110 or 210).

The connector (such as 104 or 204) also preferably comprises a bottom wall (such as 172 or 272), wherein a portion of the external PCB contacting portion (such as 192 or 292) of each pin (such as 164 or 264) extends below the bottom wall (such as 172 or 272) of the housing (such as 160 or 260, such that the external PCB contacting portion (such as 192 or 292) of each pin (such as 164 or 264) is springingly biased against an electrical contact pad (such as 150) on the external PCB (such as 102) when the disc drive (such as 100) is mounted to the external PCB (such as 102). Finally, the disc drive PCB contacting portion (such as 192 or 292) of each of the pins (such as 164 or 264) is preferably U-shaped and the external PCB contacting portion (such as 192 or 292) of each of the pins (such as 164 or 264) is preferably U-shaped.

An alternative embodiment of the present invention contemplates a system for electrically interconnecting an external PCB (such as 102) and a disc drive PCB (such as 110 or 210). The system preferably comprises an external PCB (such as 102) having an external PCB electrical connection pad (such as 150), a disc drive (such as 100) mounted to the external PCB (such as 102), the disc drive (such as 100) including a disc drive PCB (such as 110 or 210) having a disc drive PCB electrical connection pad (such as 138 or 238), and a connector (such as 104 or 204) mounted to the disc drive PCB (such as 110 or 210). The connector (such as 104 or 204) preferably includes an electrically conductive pin (such as 164 or 264), having a first a portion (such as 194 or 294) springingly biased against the disc drive PCB (such as 110 or 210) electrical connection pad (such as 138 or 238), and having a second portion (such as 192 or 292), springingly biased against the external PCB electrical connection pad (such as 150), such that a solderless connection is formed between the disc drive PCB electrical connection pad (such as 138 or 238), and the external PCB electrical connection pad (such as 150).

The system of the alternative embodiment of the present invention preferably includes a disc drive mounting area (such as 148) on the external PCB (such as 102) which is free from all electrical components other than the external PCB electrical connection pad (such as 150). Additionally, the disc drive (such as 100) is preferably mounted to the external PCB (such as 102) within this disc drive mounting area (such as 148). Furthermore, the first portion (such as 194 or 294) and the second portion (such as 192 or 292) of the pin (such as 163 or 264), is preferably U-shaped.

The system of the alternative embodiment of the present invention preferably includes base plate (such as 108 or 208) having a lower surface (such as 116 or 216) and a disc drive PCB (such as 108 or 208) having a planar substrate (such as 130 or 230) including an upper surface (such as 132 or 232) and lower surface (such as 134 or 234), wherein the upper surface (such as 132 or 232) of the disc drive PCB (such as 110 or 210) is attached in parallel relation to the lower surface (such as 134 or 234) of the base plate (such as 108 or 208).

In one embodiment of the system the connector (such as 104) is mounted to the lower surface (such as 134) of the disc drive PCB (such as 110). In another embodiment of the system the connector (such as 204) is mounted to the upper surface (such as 234) of the disc drive PCB (such as 210).

A still further embodiment of the present invention contemplates an electrical interconnect system comprising: a disc drive (such as 100) including a printed circuit board (such as 110 or 210) having a disc drive PCB electrical connection (such as 138 or 238) and an external PCB (such as 102) having an external PCB electrical connection pad (such as 150), and a means (such as 104 or 204) for creating a solderless spring connection between the disc drive PCB electrical connection pad (such as 138 or 238) and the external PCB electrical connection pad (such as 150).

It will be clear that the present invention is well adapted to attain the ends and advantages mentioned as well as those inherent therein. While a presently preferred embodiment has been described for purposes of this disclosure, various changes and modifications may be made which are well within the scope of the present invention. For example, the external PCB 102 may be the motherboard or principal printed circuit board in a hand held computing device or other form of computing device. Additionally, the disc drive may be connected to the external PCB and the PCB may be connected to the disc drive base plate by connection means other than screws. Numerous other changes may be made which will readily suggest themselves to those skilled in the art and which are encompassed in the spirit of the invention disclosed and as defined in the appended claims.

What is claimed is:

1. A system for electrically interconnecting a disc drive to an external computing environment, comprising:

an external printed circuit board (PCB) separate from the disc drive, the external PCB having an external PCB electrical connection pad;

a disc drive PCB connected to a bottom surface of the disc drive, the disc drive PCB having a disc drive PCB electrical connection pad; and a connector mounted to the disc drive PCB, the connector including an electrically conductive pin having a first portion springingly biased against the disc drive PCB electrical connection pad and having a second portion springingly biased against the external PCB electrical connection pad when the disc drive is mounted to the external PCB, such that a solderless connection is formed between the disc drive PCB electrical connection pad and the external PCB electrical connection pad.

2. The system according to claim 1, wherein the external PCB includes a disc drive mounting area which is free from all electrical components other than the external PCB electrical connection pad, and wherein the disc drive is mounted to the external PCB within the disc drive mounting area.

3. The system according to claim 2, wherein the first portion of the pin is U-shaped.

4. The system according to claim 3, wherein the second portion of the pin is U-shaped.

5. The system according to claim 4, wherein a top surface of the disc drive PCB is mounted adjacent the bottom surface of the disc drive.

6. The system according to claim 5, wherein:

the disc drive PCB electrical connection pad is located on the top surface of the disc drive PCB;

the connector is mounted to the top surface of the disc drive PCB;

the first portion of the pin extends downward from a first wall of the connector to engage the disc drive PCB electrical connection pad; and the second portion of the pin extends downward from a second wall of the connector to engage the external PCB electrical connection pad.

7. The system according to claim 5, wherein:

the disc drive PCB electrical connection pad is located on a bottom surface of the disc drive PCB;

the connector is mounted to the bottom surface of the disc drive PCB;

the first portion of the pin extends upward from a first wall of the connector to engage the disc drive PCB electrical connection pad; and the second portion of the pin extends downward from a second wall of the connector to engage the external PCB electrical connection pad.

8. The system according to claim 6, wherein:

a top wall of the connector is mounted to the bottom surface of the disc drive PCB adjacent the disc drive PCB electrical connection pad; and a bottom wall of the connector is mounted to the external PCB adjacent the external PCB electrical connection pad.

9. A disc drive assembly operable for mounting to an external printed circuit board (PCB) having a disc drive mounting area and a plurality of external PCB electrical connection pads, the disc drive assembly comprising:

a base plate having an upper surface and a lower surface;

a plurality of disc drive components connected to the upper surface of the base plate;

two mounting rails integral with and extending from the lower surface of the base plate;

a disc drive PCB mounted to the base plate between the two mounting rails, the disc drive PCB having electrical components mounted thereto and a plurality of disc drive PCB electrical connection pads;

a first connector passing through the base plate and electrically connecting at least one of the disc drive components to the disc drive PCB; and a second connector mounted to the disc drive PCB, the second connector including a plurality of electrically conductive pins, each of the pins having a disc drive PCB contacting portion springingly biased against one of the disc drive PCB electrical connection pads and having an external PCB contacting portion operable for springingly biasing against one of the plurality of external PCB electrical connection pads when the disc drive is mounted to the external PCB in the disc drive mounting area.

10. The disc drive assembly of claim 9, wherein the second connector further comprises:

an insulative housing having a plurality of passageways formed through the housing, each of the plurality of passageways receiving a fixed portion of an associated electrically conductive pin.

11. The disc drive assembly of claim 10, wherein each of the two rails has a distal edge spaced a predetermined distance from the lower surface of the base plate and wherein the insulative housing is positioned completely between the lower surface of the base plate and plane defined by the distal edges of the two rails.

12. The disc drive assembly of claim 11 wherein:

the disc drive PCB electrical connection pads are located on a top surface of the disc drive PCB mounted adjacent the lower surface of the base plate;

the insulative housing is mounted to the top surface of the disc drive PCB;

the external PCB contacting portion of each electrically conductive pin extends downward from a front wall of the insulative housing to engage the corresponding external PCB electrical connection pad; and the disc drive PCB contacting portion of each electrically conductive pin extends downward from a back wall of the insulative housing to engage the corresponding disc drive PCB electrical connection pad.

13. The disc drive assembly of claim 11 wherein:

the disc drive PCB electrical connection pads are located on a bottom surface of the disc drive PCB mounted opposite the lower surface of the base plate;

the insulative housing is mounted to the bottom surface of the disc drive PCB;

the external PCB contacting portion of each electrically conductive pin extends downward from a front wall of the insulative housing to engage the corresponding external PCB electrical connection pad; and the disc drive PCB contacting portion of each electrically conductive pin extends upward from a back wall of the insulative housing to engage the corresponding disc drive PQB electrical connection pad.

* * * * *

UNITED STATES PATENT AND TRADEMARK OFFICE

CERTIFICATE OF CORRECTION

PATENT NO. : 6,454,572 B1 
DATED : September 24, 2002
INVENTOR(S) : Konetski et al.

It is certified that error appears in the above-identified patent and that said Letters Patent is hereby corrected as shown below:

Column 8,
Line 60, replace “10” with -- 110 --.

Column 12,
Line 21, insert -- a -- before “plane”.
Line 51, replace “PQB” with -- PCB --.

Signed and Sealed this

Eighth Day of July, 2003

JAMES E. ROGAN
*Director of the United States Patent and Trademark Office*